US006569069B1

(12) United States Patent
Linares

(10) Patent No.: US 6,569,069 B1
(45) Date of Patent: May 27, 2003

(54) STRETCHING AND MASSAGING DEVICE FOR THE BACK AND SHOULDERS

(76) Inventor: Luis Alberto Nunez Linares, One Hundred Meters North from the Iglesia del Barrio San Martin de Birri, Barva Heredia (CR)

( * ) Notice: Subject to any disclaimer, the term of this patent is extended or adjusted under 35 U.S.C. 154(b) by 88 days.

(21) Appl. No.: 09/843,121

(22) Filed: Apr. 26, 2001

(30) Foreign Application Priority Data

Apr. 28, 2000 (CR) ..... 6,182

(51) Int. Cl.[7] ..... A63B 71/00

(52) U.S. Cl. ..... 482/148; 482/140; 482/142; 482/907; 601/19; 602/32

(58) Field of Search ..... 482/907, 148, 482/142, 140, 30–32, 111–113, 121, 94–96; 601/19, 18, 15, 26, 24–25; 606/243–246; 602/32

(56) References Cited

U.S. PATENT DOCUMENTS

| | | | | | |
|---|---|---|---|---|---|
| 4,451,034 | A | | 5/1984 | Gin | 272/93 |
| 4,583,731 | A | | 4/1986 | Crivello et al. | 272/144 |
| 4,927,139 | A | | 5/1990 | Taltre | 272/144 |
| 5,100,131 | A | * | 3/1992 | Fong | 482/112 |
| 5,416,939 | A | | 5/1995 | Maalouli | 5/610 |
| 5,573,485 | A | * | 11/1996 | Geschwender | 482/112 |
| 5,833,590 | A | * | 11/1998 | Chiu et al. | 482/142 |
| 5,906,564 | A | * | 5/1999 | Jacobsen | 482/96 |
| 5,913,758 | A | | 6/1999 | Nunez | 482/142 |
| 5,931,769 | A | * | 8/1999 | Nunez | 482/142 |

* cited by examiner

*Primary Examiner*—Nicholas D. Lucchesi
*Assistant Examiner*—Lori Baker Amerson
(74) *Attorney, Agent, or Firm*—Gardere Wynne Sewell LLP

(57) ABSTRACT

The present invention is a device or apparatus to stretch and massage the back and shoulders in an active way in order to naturally fix the muscles and shoulders of these areas and obtain a correct and natural position of the shoulders, spine and back. It includes a frame/base and a back support anchored to a handle in the obverse of the upper end of the support, so that the support is attached and held in place by means of a steel cable that anchors in turn to a pulley inside the motor-reductor on the base frame. The back support is attached to the base frame in its lower end by means of a pivot axis inserted in a steel countersheet joint. This system is operated through an electrical motor-reductor that gradually pulls the cable and rolls it up to an internal pulley, thus inclining or retracting the support on which the user lies face up and is firmly held against a handle or grip with his/her arms up, allowing the back muscles and shoulders to stretch and the spine to return to its correct position.

8 Claims, 3 Drawing Sheets

STRETCHING AND MASSAGING DEVICE FOR THE BACK AND SHOULDERS

RELATED APPLICATIONS

The present application claims priority of Costa Rican Application No. 6,182, entitled "Stretching and Massaging Device for the Back and Shoulders," filed Apr. 28, 2000.

BACKGROUND OF THE INVENTION

1. Field of the Invention

In general, exercise apparatuses or devices do not intend to offer a stretching treatment to the back and shoulder muscles, but to strengthen and develop muscles and improve their appearance, and do not specifically make the back and shoulder muscles go back to the body's normal and correct position. It is clear that these muscles lose their original position as time goes by due to movements such as walking or sifting, in addition to daily stress, which results in an inappropriate position.

Some of the existing devices may help the back and shoulders through a reflex effect but do not have that specific purpose, as the present invention does. This machine or stretching apparatus gives a straight answer, unknown so far, to the bending problem and loss of shape or natural position of the body. Background of stretching and exercising devices or apparatuses of similar techniques.

Patents of the United States of America number: a) U.S. Pat. No. 5,913,758., dated Jun. 22, 1999; b) U.S. Pat. No. 4,927,139; c) U.S. Pat. No. 5,416,939; d) U.S. Pat. No. 5,100,131; e) U.S. Pat. No. 4,451,034; f) U.S. Pat. No. 4,583,731.

The use of stretching and exercising devices has been observed in previous techniques. To be more specific, it is well known that devices of this kind so far conceived and used, consist basically on familiar, expected and obvious configurations. Although these devices meet their respective and particular objectives and requirements, the patents previously mentioned do not reveal any new stretching device.

This device includes a base frame and a back support with rollers, which is anchored to a motor pulley with a steel cable in the lower part of such frame. The support is attached to the upper part using the same cable, which is attached by means of a handle. The steel cable that joins these two points is retractile so as to obtain the stretching movement. The lower end of the support is attached to the frame using a support pivot axis inserted in the countersheet joint that forms the support.

To this regard, the stretching device, according to the present invention, is substantially different from the conventional concepts and designs of previous techniques, and therefore offers an apparatus developed mainly with the purpose to stretch and massage the users back and shoulders so as to get a normal position for the back.

2. Detailed Description

In view of the advantages previously mentioned inherent to the types of stretching and exercising devices observed in previous techniques, the current invention offers the possibility to manufacture a new stretching device that may be used to stretch and massage the back and shoulders in an active way, naturally fix the muscles and bones of such areas, and obtain a correct and natural position of shoulders, spine and back.

The general purpose of this invention, described below in detail, is to provide a new stretching and massaging apparatus and method with most of the advantages of the stretching and exercising devices mentioned before, in addition to several new characteristics that result in a new stretching device that has not been anticipated, suggested or even insinuated in any other stretching and exercising device, either alone or a combination thereof.

In order to achieve such purpose, the present invention generally includes a base frame and a back support with rollers, which is anchored to a motor pulley with a steel, cable in the lower part of such frame. The support is attached to the upper part using the same cable, which is attached by means of a handle. The steel cable that joins these two points is retractile so as to obtain the stretching movement. The lower end of the support is attached to the frame using a support pivot axis inserted in the countersheet joint that forms the support.

A general summary of the most important characteristics of the invention has been done, so that the following detailed description may be easily understood and the contribution to the technique be more appreciated.

To this regard, before explaining in detail at least one representation of the invention, it must be understood that said invention's application is not limited to the construction details and the arrangement of the components stated in the following description or shown in the drawings. The invention may have other representations and be practiced or carried out in several ways and with different materials. Also, it must be remembered that the phraseology and terms herein used have descriptive purposes and may not be seen as obstacles thereof.

Therefore, those who are familiar with this technique will appreciate that the concept on which this information is based may be used as a starting point for the design of other structures, methods and systems to achieve the different purposes of the present invention.

Moreover, the object of the previous summary is to help the Patents Registry of Costa Rica and the general public, especially scientists, engineers and practitioners of this technique who are not familiar with patents or legal terms or phrases, so that, with a superficial inspection, they may quickly determine the nature and essence of the technical information the application has. The summary neither intends, in any way whatsoever, to define the invention of the application, which is measured by the patent requests, nor be an obstacle or limitation regarding the invention ambit.

1. The main purpose of the present invention is to provide a new device and method that may be used to stretch and massage the users back and shoulders in an active way, naturally fix the muscles and bones of such areas and obtain a proper and natural position of the shoulders, spine, back and internal organs. It has many of the advantages of the stretching and exercising devices mentioned above, in addition to several new characteristics that result in a stretching device that has not been anticipated, suggested or even insinuated in any other stretching and exercising device in previous techniques, either alone or a combination thereof.

2. To provide a new stretching device that may be manufactured and marketed easy and efficiently, at a lower cost compared to the ones already known.

3. To provide a new, lasting, and reliable stretching device that may be manufactured with several kinds of materials, easy to handle due to its light weight compared to the ones already known.

4. To offer a new stretching device with low manufacture costs regarding materials and labor, consequently having low sale prices for the consumers to make it affordable.

5. To provide a new stretching device that offers some of the advantages of the apparatuses and methods with older techniques, but that exceeds some of the advantages regularly associated with them. This will benefit the central nervous system, which is intimately linked to the back and spine.

6. To offer a new device to stretch, naturally fix and massage the user's back and shoulders in an active way.

7. To offer a new stretching device that includes a base frame and a back support, which is anchored to a motor pulley with a steel cable in the lower part of such frame. The support is attached to the upper part using the same cable, which is also attached by means of a handle. The steel cable that joins these two points is retractile so as to achieve the stretching movement. The lower end of the support is attached to the frame using a support pivot axis inserted in the countersheet joint that forms the support.

8. To help many people who suffer from pain and problems when their back is misaligned and their internal organs change position as a consequence of the pressure for sifting or standing during a prolonged period. Therefore, this invention will provide a new stretching device that helps property align the vertebrae of the users back and return the muscles and internal organs to their original position, thus relieving any back pain they may have.

BRIEF DESCRIPTION OF THE DRAWINGS

The invention will be better understood and the objectives not established before will become apparent when the following detailed description is observed, which makes reference to the annexed illustrations.

Figure 3:
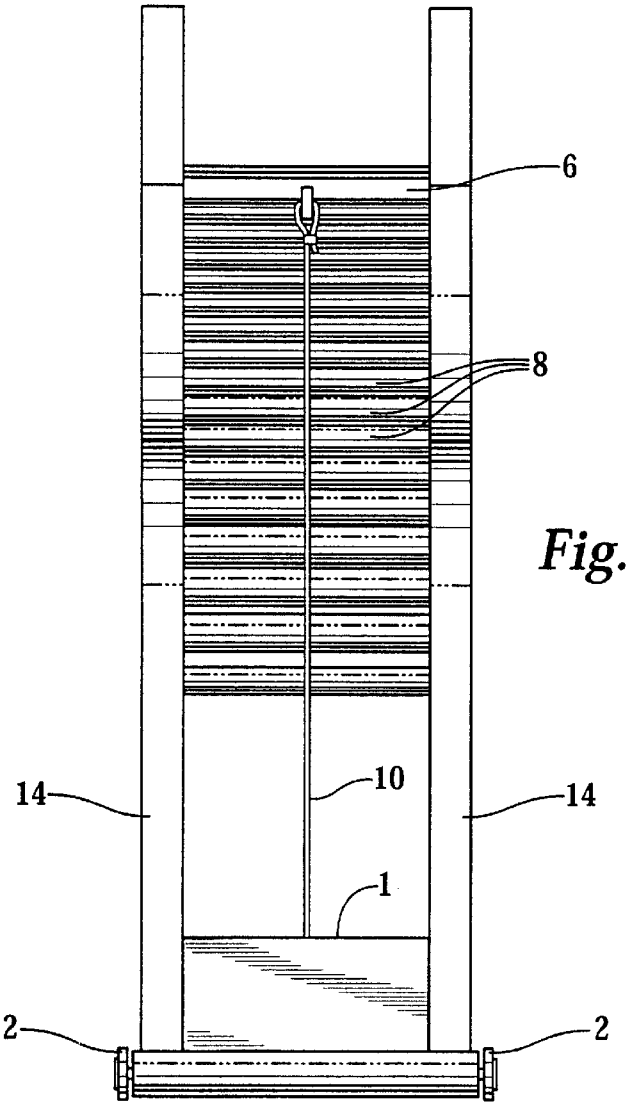
FIG. 3 is a general view of a new stretching device according to the present invention, seen from the front, which shows the frame, support and other elements composing such invention.

To better understand the drawings, the mentioned parts are indicated in FIG. 3, that is:

1. Motor protection box
2. Wheels
3. Frame or base
4. Adjustable support for the feet
5. Support or handle for the hands
6. Side sheets
7. Control box (time and start up)
8. Sponge rollers
9. Grip or handle to stretch the shoulders
10. Steel cable
11. Countersheet
12. Axis
13. General device
14. Support
15. Upperend
16. Lower end
17. Support tube for frame/base
18. T-shaped front support tube
19. T-shaped back support tube
20. Roller support

DESCRIPTION OF THE PREFERRED EMBODIMENTS

Figure 1:
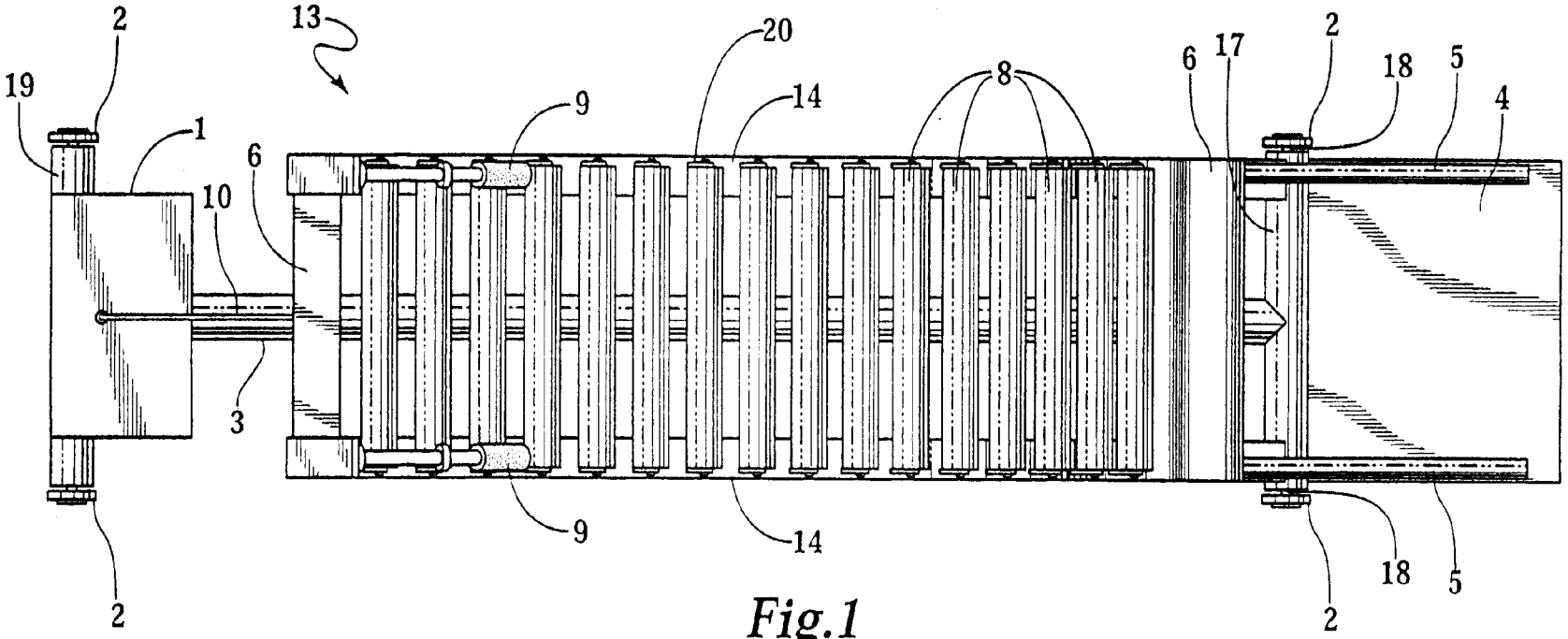
FIG. 1. is a view of the base frame of a new stretching device according to the present invention, seen from above.
Figure 2:
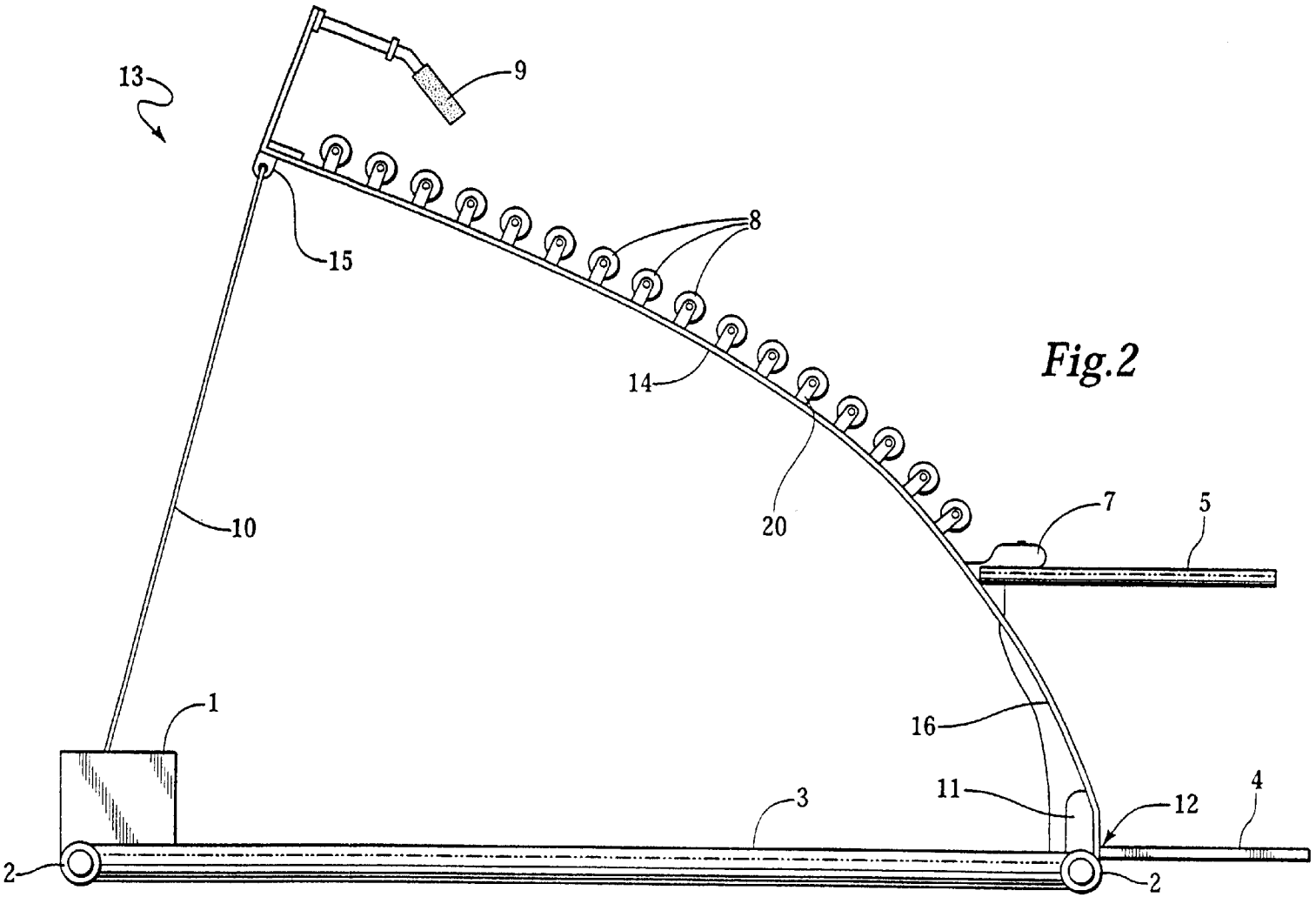
FIG. 2. is a side view of the present invention with the back support in a reclined position, where the parts will be detailed.

Making reference to the illustrations, especially FIGS. 1 to 3, a new stretching and massaging device that represents the principles and concepts of the present invention is described, as shown in FIG. 3 and globally identified with number 13.

The stretching device 13 is designed to stretch and massage the user's back and shoulders in an active way, naturally fix the muscles and bones of such areas and obtain a proper and natural position of the shoulders, spine, back and internal organs.

As FIGS. 1 to 3 show, this device 13 generally includes a frame/base 3 and a back support 14 with rollers 8 attached using a steel cable 10, which is in turn anchored to a motor pulley by means of a steel cable 10 in the lower part of such frame or base 3; the other side of the support 14 is attached to the upper part 15 by means of the same cable 10.

The lower end 16 of the support 14 is attached using an axis 12 to the front end of the base/frame 3, and also to the adjustable support for the feet 4, whereas the upper end 15 of the support 14 is pulled backwards in a gradual manner with the steel cable 10 in order to obtain the torsion and support angle 14 so as to achieve the stretching and massaging purpose.

In a more detailed manner, the support 14 has an upper part 15, a lower part 16, a frontal part and a back part, a pair of side sheets 6 that form the sides and extend from the lower end 16 to the upper end 15, in such a way that the sponge rollers 8 are transversally welded to the side sheets 6 joining both sheets 6 to form the support 14. The control box 7 is placed towards the lower end 16 of the right sheet 6 and on the support or handle for the hands 5. The grips or handles to stretch the shoulders 9, which are adjustable depending on the users size, are towards the upper end 15 in each one of the ends of side sheets 6.

The frame/base 3 is composed by a T-shaped support tube 17 that starts and joins in the lower end 16 with the countersheet 11, the axis 12 and the adjustable support for the feet 4, to continue the support tube 17 perpendicular to the support 14 to finish in a T-shaped end that supports the motor protector box 1 and wheels 2. The support tube 17 has also a rail or T-shaped front tube 18 to provide additional stability to the base in the front. In like manner, it has a back tube or rail 19 that gives additional stability to the frame/base and serves as support to the motor and the motor protector box 1.

The sponge rollers 8 are screwed to some L-shaped pieces or supports 20, which are in turn welded to the sheets 6. These rollers 8 are not fixed and are rotatory following the user's movement and consequently massaging the muscles.

The handles 5 or grips to stretch the shoulders 9 are arranged in the upper end 15 and are adjustable depending on the user's height. In like manner, they allow the user to have something to grab so as to get the full arching of the back and an active stretching of the shoulders.

The supports or handles for hands 5 let the user have an additional support point even when he/she does not want to use the handles to stretch the shoulders 9. Therefore, the user may have an additional support point even when not using the handles or grips 9. In this way, the supports 5 serve to pull and place the machine in a more agile and safe manner.

The adjustable support for the feet 4 is adapted to maintain the user's feet in the standing position to help change the position of the feet depending on the user's height and requirements, thus allowing a comfortable and relaxed position when using the handles or grips for shoulders 9.

The cable 10 anchors to a motor pulley located in the lower part of the frame/base. The support 14 is attached to the upper end using the same cable 10, which is also attached by means of a handle. The steel cable 10 that joins these two points is retractile and flexible so as to achieve the stretching movement.

When in use, the user stands on the adjustable support for the feet 4 and leans on the back support 14, then he/she turns the control box 7 on, and the back support 14 reclines downwards in an arched position when pulled by cable 10. The support 14 goes down towards the back end of the frame/base 3 forming a curvature optimal to stretch and massage the back and shoulders. Once the cable 10 reaches the top, it stops automatically and starts the return of the support 14 upwards, thus generating a retraction and return movement of the cable 10 that generates the massaging movement in a soft and natural way.

In regards to the previous description, it must be understood that the optimal dimensional relations for the parts of this invention to include variations in size, materials, shape, function, operation and assembly are considered immediately apparent and obvious for a person familiar with the technique, and all relations equivalent to those illustrated in the drawings and described in the specifications have the purpose to be included in the present invention.

Therefore, the above said has illustrative purposes for this invention only. Moreover, since several changes and modifications will immediately occur for those skilled people, the invention must not be limited to the construction and operations shown and described, and all the proper and equivalent modifications may be rearranged to fit within the ambit thereof.

What is claimed is:

1. A device to stretch and massage the user's back and shoulders in an active way that includes: a frame/base and a back support of steel sheets attached with each other with rollers transversally placed, which is in turn anchored to a motor-reductor pulley with a steel cable in the lower end of such frame/base. This support is also attached to the upper part of the support using the same cable, which is also attached by means of a handle, in such a way that the steel cable joining these two points is retractile so as to get a swinging movement to cause the stretching and massaging. The lower end of the support is attached to the frame with a support axis inserted in the countersheet joint that forms the support. The system is operated through an electrical motor-reductor that gradually pulls the cable and rolls it up inside the motor, thus inclining or retracting the support on which the user lies face up and is firmly held against the support or grip with his/her arms upwards.

2. Stretching or massaging device described in claim 1. The frame/base has front and a back T-shaped supports with wheels and is attached to the lower end of the support with a countersheet and an axis, where an adjustable support for the feet is in turn held.

3. Device described in claim 2. The frame/base has a motor-reductor with a protector cover on the tube of the T-shaped back support, which in turn anchors a retractile steel cable that pulls and inclines the support. This cable has a top for the support that is returned in a soft and natural way.

4. Device described in claim 1. The back support is inclined backwards perpendicular to the base when it is pulled by a cable. It is formed by steel sheets attached with each other by movable rollers transversally placed and screwed to L-shaped roller supports.

5. Device described in claim 4. There is a row of sponge rollers for the damping and massage that go from the upper end to the control level or control box, with a length extending between the upper and lower ends of the support.

6. Device described in claim 4. There is an adjustable support for the feet in the lower end adapted to hold the feet of a user in standing position.

7. Device described in claim 4. There are two handles or grips to stretch the shoulders in the upper end that help the user arch his/her body in a comfortable and natural way following the swinging movement of the motor.

8. Device described in claim 4. There are two supports or handles for the hands at the height of the control box that help the user have some support and safety when he/she enters or leaves the machine and rests his/her hands when in relaxed position.

* * * * *